US007980879B2

(12) United States Patent
Suzuki et al.

(10) Patent No.: US 7,980,879 B2
(45) **Date of Patent: *Jul. 19, 2011**

(54) CONNECTION STRUCTURE

(75) Inventors: Sachio Suzuki, Hitachi (JP); Hideaki Takehara, Hitachi (JP); Kunihiro Fukuda, Tsukuba (JP); Yuta Kataoka, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/801,305

(22) Filed: Jun. 2, 2010

(65) Prior Publication Data

US 2011/0130022 A1 Jun. 2, 2011

(30) Foreign Application Priority Data

Nov. 30, 2009 (JP) ..... 2009-272318

(51) Int. Cl.
*H01R 4/50* (2006.01)

(52) U.S. Cl. ..... 439/346

(58) Field of Classification Search ..... 439/346, 439/359

See application file for complete search history.

(56) References Cited

U.S. PATENT DOCUMENTS

| | | | | | |
|---|---|---|---|---|---|
| 2,956,139 | A | * | 10/1960 | Paddock | 200/246 |
| 4,136,919 | A | * | 1/1979 | Howard et al. | 439/346 |
| 5,692,921 | A | * | 12/1997 | Jennings | 439/346 |
| 2009/0075506 | A1 | | 3/2009 | Suzuki | |

FOREIGN PATENT DOCUMENTS

| | | | |
|---|---|---|---|
| JP | 2004-56924 | A | 2/2004 |
| JP | 4037199 | B2 | 11/2007 |
| JP | 2009-70754 | A | 4/2009 |

* cited by examiner

*Primary Examiner* — Gary F. Paumen
(74) *Attorney, Agent, or Firm* — McGinn IP Law Group, PLLC

(57) ABSTRACT

A connection structure includes a first terminal housing with first connecting terminals, a second terminal housing with second connecting terminals, isolating plates in the first terminal housing, a connecting member to collectively fix the first connecting terminals and the second connecting terminals at the contacts therebetween for electrical connections between the first connecting terminals and the second connecting terminals. The connecting member further includes a metallic elastic member disposed between the head and the isolating plate adjacent to the head to sequentially press the isolating plates in a stacking direction. The isolating plate adjacent to the head includes a recessed portion formed in a surface to contact the elastic member for accommodating one end of the elastic member pressing the isolating plate adjacent to the head.

8 Claims, 4 Drawing Sheets

1 CONNECTOR
4a-4c FIRST CONNECTING TERMINALS
5 FIRST TERMINAL HOUSING
6a-6c FIRST CONNECTING TERMINALS
7 SECOND TERMINAL HOUSING
9 CONNECTING MEMBER

1 CONNECTOR
5 FIRST TERMINAL HOUSING
7 SECOND TERMINAL HOUSING
9 CONNECTING MEMBER
15 ELASTIC MEMBER
16 RECESSED PORTION
17 RECEIVING MEMBER

100 CONNECTOR
5 FIRST TERMINAL HOUSING
7 SECOND TERMINAL HOUSING
9 CONNECTING MEMBER
15 ELASTIC MEMBER
16 RECESSED PORTION
17 RECEIVING MEMBER

CONNECTION STRUCTURE

The present application is based on Japanese patent application No. 2009-272318 filed on Nov. 30, 2009, the entire contents of which are incorporated herein by reference.

BACKGROUND OF THE INVENTION

1. Field of the Invention

The present invention relates to a connection structure, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal.

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP patent No. 4037199, is known in the art.

JP patent No. 4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor. The technique used in the electrical connection structure disclosed by JP patent No. 4037199 is as follows: Each phase connecting terminal of the conductive member and each corresponding phase connecting terminal of the power line cable are overlapped, and isolating members are disposed on opposite surfaces to the overlapped surfaces of the connecting terminals, respectively, and these overlapped connecting terminals and isolating members are collectively fastened in an overlapping direction with a single bolt provided in a position to penetrate these overlapped connecting terminals and isolating members.

That is, in the technique used in the electrical connection structure disclosed by JP patent No. 4037199, the single bolt is tightened in the overlapping direction, to collectively hold the multiplicity of contacts between the connecting terminals, which are the overlapped surfaces of the connecting terminals, and thereby fix the connecting terminals at the contacts therebetween, for electrical connections between the connecting terminals, respectively. This configuration disclosed by JP patent No. 4037199 is effective in easily ensuring size reduction, compared to a technique disclosed by JP-A-2009-070754.

Refer to JP-A-2009-070754 and JP Patent No. 4037199, for example.

Also, in JP patent No. 4037199, a spring washer indicated by numeral 43 is used. This spring washer 43 is effective in exerting a proper pressing force while the stroke of tightening the bolt indicated by numeral 18 is being regulated by a metallic collar indicated by numeral 41.

In JP Patent No. 4037199, however, the thickness of the isolating member indicated by numeral 31 disposed adjacent to the spring washer 43 is generally determined by taking into consideration the electricity movement from the contact to the spring washer 43, and the spring washer 43 is simply attached to on the isolating member 31, therefore leading to an increase in the thickness in the overlapping direction of the electrical connection structure due to the thickness of the spring washer 43.

To make the size of the electrical connection structure very small, the present inventors have ensured that the electrical connection structure is further slimmed.

SUMMARY OF THE INVENTION

Accordingly, it is an object of the present invention to provide a connection structure possible to slim, when having a plurality of first connecting terminals, a plurality of second connecting terminals, and a plurality of isolating plates to be stacked therein, by pressing a connecting member in the stacking direction to thereby collectively fix the plural first connecting terminals and the plural second connecting terminals at the contacts therebetween for electrical connections between the plural first connecting terminals and the plural second connecting terminals, respectively, and even when provided with an elastic member for exerting a pressing force.

(1) According to one embodiment of the invention, a connection structure comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a head and a shaft connected to the head, the shaft being adapted to penetrate contacts between the plurality of first connecting terminals and the plurality of second connecting terminals and the plurality of isolating plates, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, the connecting member further comprising at least a portion comprising an insulating material for penetrating the contacts, wherein the connecting member further comprises a metallic elastic member disposed between the head and the isolating plate adjacent to the head to sequentially press the plurality of isolating plates in a stacking direction, and the isolating plate adjacent to the head comprises a recessed portion formed in a surface to contact the elastic member for accommodating one end of the elastic member pressing the isolating plate adjacent to the head.

(2) According to another embodiment of the invention, a connection structure comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a head adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, wherein the connecting member further comprises a metallic elastic member disposed between the head and the isolating plate adjacent to the head to sequentially press the plurality of isolating plates in a stacking direction, and the isolating plate adjacent to the head comprises a recessed portion formed in a surface to contact the elastic member for accommodating one end of the elastic member pressing the isolating plate adjacent to the head.

In the above embodiments (1) and (2), the following modifications and changes can be made.

(i) The connection structure further comprises a metallic receiving member at a bottom of the recessed portion for receiving the elastic member.

(ii) The first terminal housing comprises a connecting member insertion hole for inserting the connecting member thereinto, and the connecting member further comprises a waterproofing structure on an outer surface of the head for sealing between the outer surface of the head and an inner surface of the connecting member insertion hole of the first terminal housing.

(iii) The connecting member insertion hole is formed cylindrical, and bent inward at an end of the cylindrical shape facing into the first terminal housing, and a rim of a lower surface of the head of the connecting member is contacted with the bent end of the connecting member insertion hole, to thereby regulate the stroke of the connecting member.

(iv) The first terminal housing is a male terminal housing, the second terminal housing is a female terminal housing, and the second terminal housing comprises a through hole for permitting the connecting member to be inserted into or removed out of the first terminal housing after the first terminal housing and the second terminal housing are fitted to each other.

(v) The plurality of second connecting terminals are connected with flexible cables, respectively, at one end, and the second terminal housing further comprises a cable holding member for holding the cables, so that the plurality of second connecting terminals are held at specified positions, respectively, with flexibility relative to the second terminal housing.

Points of the Invention

According to one embodiment of the invention, a recessed (or concave) portion for accommodating one end of an elastic member disposed between a head of a connecting member and an isolating plate adjacent to the connecting member is formed on the surface opposite the elastic member of the isolating plate. For that reason, the height of the elastic member exposed from the surface of the isolating plate can be reduced the amount accommodated in the recessed portion, so that the connector can be rendered more low-profile than that in the prior art.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a first embodiment, referring to the accompanying drawings.

Herein is described a connector as one example of a connection structure of the invention.

First Embodiment

Figure 1:
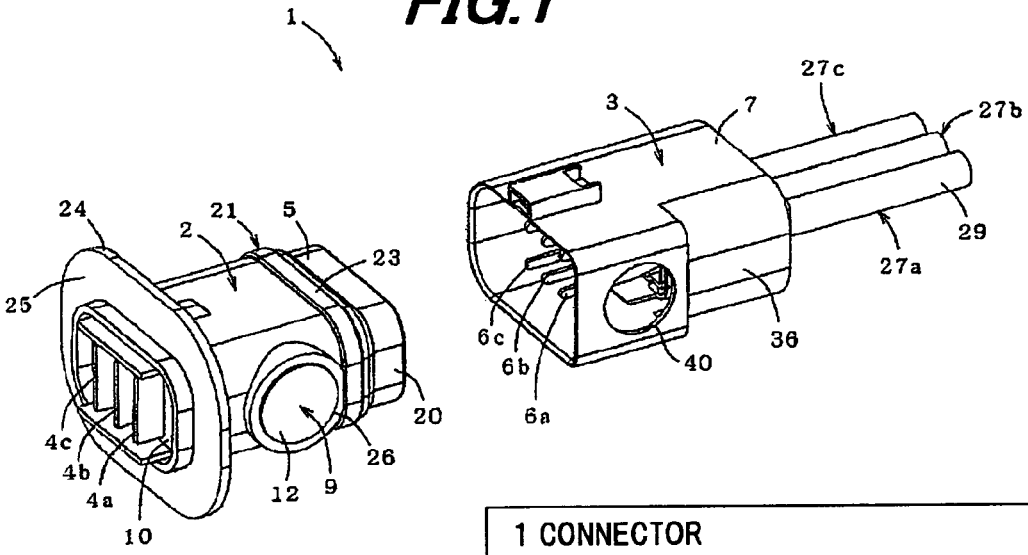
FIG. 1 is a perspective view showing a first connector portion and a second connector portion constituting a connector in a first embodiment according to the invention.
Figure 2:
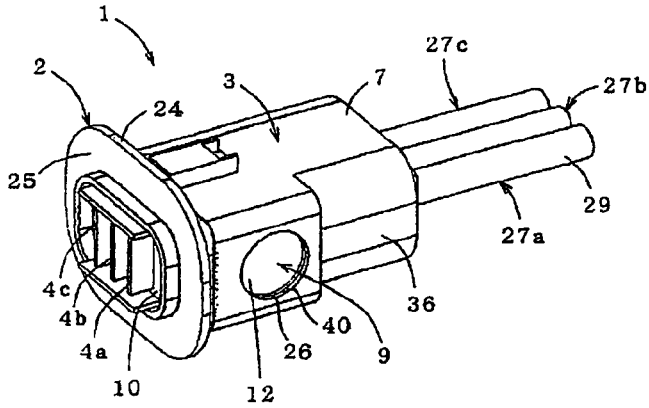
FIG. 2 is a perspective view showing the connector after connecting together the first connector portion and the second connector portion.
Figure 3:
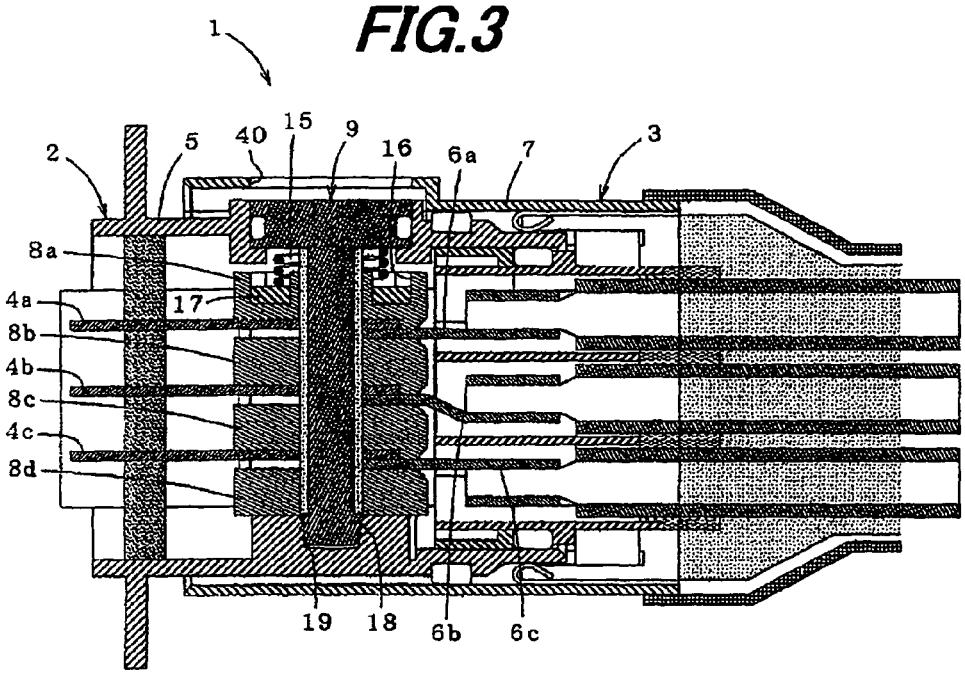
FIG. 3 is a cross-sectional view showing the connector after connecting together the first connector portion and the second connector portion.

FIG. 1 is a perspective view showing an unconnected state of a first connector portion and a second connector portion of a connector in a first embodiment according to the invention, FIG. 2 is a perspective view showing the connector when connecting the first connector portion and the second connector portion, and FIG. 3 is a cross-sectional view of the connector when connecting the first connector portion and the second connector portion. In FIGS. 1 to 4, 9 and 10, although a recessed portion, into which is engaged a hexagonal wrench (also called hexagonal spanner) is being formed in an upper surface of a head 9*b* of a bolt 12 used as a connecting member 9, it is being omitted.

Connector 1 Structure

As shown in FIGS. 1 to 3, the connector 1 in this embodiment is constructed of a first connector portion 2 and a second connector portion 3, which are fitted to each other, to thereby collectively connect a plurality of power lines.

More specifically, the connector 1 includes the first connector portion 2 having a first terminal housing 5 with a plurality of (three) first connecting terminals (male terminals) 4*a* to 4*c* aligned and accommodated therein, the second connector portion 3 having a second terminal housing 7 with a plurality of (three) second connecting terminals (female terminals) 6*a* to 6*c* aligned and accommodated therein, and a plurality of isolating plates 8*a* to 8*d* aligned and accommodated in the first terminal housing 5. When the first terminal housing 5 of the first connector portion 2 and the second terminal housing 7 of the second connector portion 3 are fitted to each other, the plural first connecting terminals 4*a* to 4*c* and the plural second connecting terminals 6*a* to 6*c* face each other to form pairs, respectively (i.e. each pair of the first connecting terminal 4*a* and the second connecting terminal 6*a*, the first connecting terminal 4*b* and the second connecting terminal 6*b*, and the first connecting terminal 4*c* and the second connecting terminal 6*c*), and result in a stacked structure of the pairs of the first connecting terminals 4*a* to 4*c* and the second connecting terminals 6*a* to 6*c* alternately interleaved with the plural isolating plates 8*a* to 8*d*. That is, connecting the first terminal housing 5 of the first connector portion 2 and the second terminal housing 7 of the second connector portion 3 results in the connector 1 in this embodiment in which are stacked the plural first connecting terminals 4*a* to 4*c* and the plural second connecting terminals 6*a* to 6*c* and the plural isolating plates 8*a* to 8*d*.

This connector 1 is used for connection of a vehicle drive motor and an inverter for diving that motor, for example.

More specifically, the first terminal housing 5 of the first connector portion 2 (in FIG. 1, left side portion) is fitted to a shield case of the motor, and the first connecting terminal 4*a* to 4*c* portions exposed from the first terminal housing 5 are connected to terminals, respectively, of a terminal block installed in the shield case of the motor. Fitting to the first connector portion 2 the second connector portion 3 electrically connected with the inverter results in electrical connection of the motor and the inverter. Although the foregoing is concerned with the motor side connection, the same applies to the inverter side connection.

First and Second Connector Portions 2 and 3

Below are described the respective specific structures of the first connector portion 2 and the second connector portion 3.

First Connector Portion 2

Figure 4:
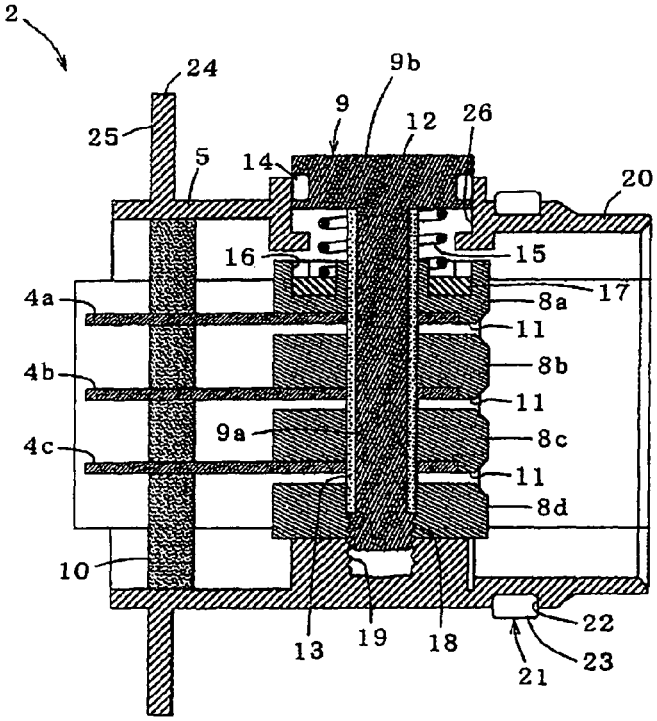
FIG. 4 is a cross-sectional view showing the first connector portion.

Referring to FIG. 4, the first connector portion 2 has the three first connecting terminals 4*a* to 4*c* held therein to be aligned at a specified pitch, and includes the first terminal housing 5 for accommodating the three aligned first connecting terminals 4*a* to 4*c*, the plural substantially rectangular parallelepiped isolating plates 8*a* to 8*d* provided in the first terminal housing 5 for isolating each of the first connecting terminals 4*a* to 4*c*, and a connecting member 9 with a head 9*b* and a shaft 9*a* connected to the head 9*b*, whose shaft 9*a* penetrates each contact between the plural first connecting terminals 4*a* to 4*c* and the plural second connecting terminals 6*a* to 6*c* and the plural isolating plates 8*a* to 8*d*, and whose head 9*b* is pressed against the adjacent isolating plate 8*a*, to thereby collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively. At least a portion of the connecting member 9, which penetrates each contact, is formed of an insulating material.

The first terminal housing 5 may be a male or female terminal housing. Herein is described the case that the first terminal housing 5 is a male terminal housing as one example.

First Connecting Terminals 4*a* to 4*c*

The first connecting terminals 4*a* to 4*c* are plate terminals, and are held to be aligned at a specified pitch by being spaced apart from each other by a molded resin material 10 formed of an insulating resin (e.g. PPS (polyphenylene sulfide) resin, PPA (polyphthalamide) resin, PA (polyamide) resin, PBT (polybutylene terephthalate), epoxy based resin), which forms a portion of the first terminal housing 5. As a method for holding the first connecting terminals 4*a* to 4*c* with the molded resin material 10, there is a holding method by inserting the first connecting terminals 4*a* to 4*c* during molding of the molded resin material 10 and then curing the resin, or a holding method by pressing the first connecting terminals 4*a* to 4*c* into the molded resin material 10 which has been molded beforehand.

The first connecting terminals 4*a* to 4*c* are supplied with electricity at different voltages and/or currents, respectively. For example, in this embodiment, power lines are assumed to be for three phase alternating current between a motor and an inverter, so that the first connecting terminals 4*a* to 4*c* are supplied with alternating currents, respectively, which are 120 degrees out of phase with each other. For the purpose of reducing the loss of power transmitted through the connector 1, the first connecting terminals 4*a* to 4*c* may each be formed of a metal such as a high conductivity silver, copper, aluminum, or the like. Also, the first connecting terminals 4*a* to 4*c* each have slight flexibility.

Isolating Plates 8*a* to 8*d*

The plural isolating plates 8*a* to 8*d* comprise the plurality of first isolating plates 8*a* to 8*c* aligned and accommodated in the first terminal housing 5, and integrally fixed to one side of the plural first connecting terminals 4*a* to 4*c*, respectively, (i.e. to the opposite side to the side joined with the second connecting terminals 6*a* to 6*c*), and the second isolating plate 8*d* provided to be integrally fixed to an inner surface of the first terminal housing 5, and to face one side of the second connecting terminal 6*c* (i.e. the opposite side to the side joined with the first connecting terminal 4*c*) positioned at the outermost side when stacking the plural first connecting terminals 4*a* to 4*c* and the plural second connecting terminals 6*a* to 6*c*.

The plural isolating plates 8*a* to 8*d* are fixed at such a position as to protrude from the tips of the first connecting terminals 4*a* to 4*c*. Each of these isolating plates 8*a* to 8*d* is chamfered at each of its corners on the second connecting terminal 6*a* to 6*c* inserting/removing side.

Figure 5A:
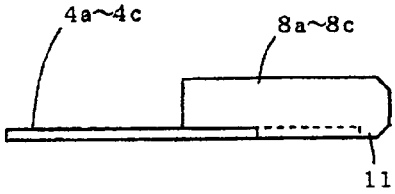
FIGS. 5A and 5B are a side view and a bottom view, respectively, showing a first connecting terminal.
Figure 5B:
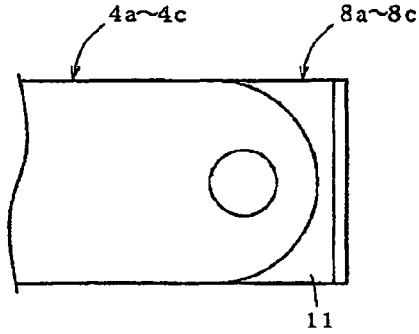

Also, referring to FIGS. 5A and 5B, each of the plural first isolating plates 8*a* to 8*c* is formed with a protruding portion (thickened surface) 11 of its surface fixed to the first connecting terminals 4*a* to 4*c* to fill the level difference therebetween, so that the lower surfaces (i.e., the bottom faces in FIG. 5A) of the plural first isolating plates 8*a* to 8*c* are flush with the lower surfaces (i.e., the bottom faces in FIG. 5A) of the first connecting terminals 4*a* to 4*c*, respectively. With this configuration, when the first connector portion 2 and the second connector portion 3 are fitted to each other, the tips of the first connecting terminals 4*a* to 4*c* do not contact the inserted tips of the second connecting terminal 6*a* to 6*c*. The insertability of the second connecting terminal 6*a* to 6*c* is therefore enhanced. In FIG. 5A, the structure of the first isolating plate 8*a* is depicted as being simplified, and the first isolating plates 8*a* to 8*c* are depicted likewise.

Connecting Member 9

Referring again to FIG. 4, the connecting member 9 has the shaft 9*a* with a portion, which penetrates each contact between the plural first connecting terminals 4*a* to 4*c* and the plural second connecting terminals 6*a* to 6*c*, formed of an insulating material, and the head 9*b* formed integrally with the shaft 9*a*, which serves as a pressing portion to be pressed against the adjacent first isolating plate 8*a*.

More specifically, the connecting member 9 comprises a bolt (bolt with a hexagonal hole) 12 made of a metal (e.g. SUS, iron, copper alloy, or the like) and an insulating layer 13 formed of an insulating resin material (e.g. PPS (polyphenylene sulfide) resin, PPA (polyphthalamide) resin, PA (polyamide) resin, PBT (polybutylene terephthalate), epoxy based resin), which coats the perimeter of the shaft 9*a* (including the portion penetrating each contact) of that bolt 12.

The entire connecting member 9 formed of an insulating resin may be used, but the connecting member 9 coated with the insulating layer 13 around the perimeter of the shaft 9*a* of the metallic bolt 12 is preferable from the point of view of strength. That is, the connecting member 9 having the combined structure of the metallic bolt 12 and the insulating layer 13 made of an insulating resin can have enhanced strength, compared to the entire connecting member 9 formed of an insulating resin. As the insulating resin for coating the metallic bolt 12, it is preferred to use an insulating resin, which has a linear expansion coefficient approximate to a linear expansion coefficient of a metal forming the bolt 12, to prevent creep.

Elastic Member 15

The head 9*b* of the connecting member 9 is provided with a packing 14 therearound for preventing water from penetrating into the first terminal housing 5. Also, between the lower surface of the head 9*b* of the connecting member 9 and the upper surface of the first isolating plate 8*a* directly therebelow is provided an elastic member 15 for applying a specified pressing force to the first isolating plate 8*a*. The elastic member 15 is a spring made of a metal (e.g. SUS, or the like). In this embodiment, the elastic member 15 constitutes a portion of the connecting member 9. In other words, the connecting member 9 includes the metallic elastic member 15 disposed between the head 9*b* and the first isolating plate 8*a* adjacent thereto, to, in turn, press the first isolating plate 8*a*, the first isolating plate 8*b*, the first isolating plate 8*c*, and the second isolating plate 8*d* in the stacking direction (i.e., downward from above in FIG. 3).

Recessed Portion 16

In an upper surface of the first isolating plate 8*a* to be in contact with a lower portion of the elastic member 15, i.e., in the side to be in contact with the elastic member 15 of the first isolating plate 8*a* adjacent to the head 9*b*, is formed a recessed portion 16 which covers (accommodates) a lower portion at one end of the elastic member 15. At the bottom of the recessed portion 16 (i.e. the base to be in contact with the lower portion of the elastic member 15) is provided a receiving member 17 made of a metal (e.g. SUS, or the like) which receives the elastic member 15 and which is for preventing damage to the first isolating plate 8*a* formed of an insulating resin.

The receiving member 17 prevents damage to the first isolating plate 8*a* by dispersing stress applied to the upper surface of the first isolating plate 8*a* from the elastic member 15. It is therefore preferred to make the contact area between the receiving member 17 and the first isolating plate 8*a* as large as possible. In this embodiment, to make the contact area between the receiving member 17 and the first isolating plate 8*a* large, the receiving member 17 shaped in a manner that contacts the entire surface of the bottom of the recessed portion 16 is provided.

This connecting member 9 is inserted into the first terminal housing 5 from above the first connecting terminal 4*a* to 4*c* surfaces (i.e., the upper surfaces in FIG. 3) to which are fixed the first isolating plates 8*a* to 8*c*, respectively. A screwing portion 18 at a tip of the shaft 9*a* is then screwed into a screw hole 19 formed in an inner surface of the first terminal housing 5, to thereby allow the connecting member 9 to press the plural first connecting terminals 4*a* to 4*c* and the plural second connecting terminals 6*a* to 6*c* from its head 9*b* toward the tip of its shaft 9*a* (i.e., downward from above in FIG. 3), and collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively.

First Terminal Housing 5

The first terminal housing 5 is formed of a cylindrical hollow body 20 which is substantially rectangular in transverse cross section. An outer portion at one end (i.e., rightward in FIG. 4) of the cylindrical body 20 fitted to the second terminal housing 7 is formed in a tapered shape, taking into consideration the mateability with the second connector portion 3. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (i.e., leftward in FIG. 4) of the cylindrical body 20 is accommodated a molded resin material 10 with the first connecting terminals 4*a* to 4*c* aligned and held therewith. In an outer portion at the other end of the cylindrical body 20 is formed a flange 24 (an attachment hole omitted) for fixing the first connector portion 2 to a device chassis (e.g. a motor shield case). At a rim 25 of the flange 24 having the attachment hole for bolt insertion and fixation to a device chassis may be provided a packing for sealing between the first connector portion 2 and the device chassis. The structure of this flange 24 is not assumed as fixing the first connector portion 2 to a device chassis, but the flange 24 may be provided in the second connector portion 3, or in both the first connector portion 2 and the second connector portion 3. Also, both of the first connector portion 2 and the second connector portion 3 may be free or not fixed to a device chassis.

Also, this flange 24 is effective in enhancing the dissipation of heat. That is, the formation of the flange 24 permits a large surface area of the first terminal housing 5, thereby allowing enhancement in the dissipation to outside via the first terminal housing 5, of heat produced inside the first connector portion 2 (e.g. heat produced at each contact).

In an upper portion (i.e., upward in FIG. 4) of the cylindrical body 20 is formed a connecting member insertion hole 26 for inserting the connecting member 9. The connecting member insertion hole 26 is formed in a cylindrical shape, and bent inward at a lower end (i.e., downward in FIG. 4) of that cylindrical shape. A rim of the lower surface of the head 9*b* of the connecting member 9 is contacted with this bent portion of the connecting member insertion hole 26, to thereby regulate the stroke of the connecting member 9.

For shielding performance, heat dissipation, and weight reduction of the connector 1, the cylindrical body 20 is formed of, preferably a high electrical conductivity, high thermal conductivity and lightweight metal such as an aluminum, but may be formed of a resin, or the like. In the case that the first terminal housing 5 is formed of an insulating resin, the second isolating plate 8*d* and the first terminal housing 5 may integrally be formed of the insulating resin. The cylindrical body 20 formed of an aluminum as mentioned above allows the connecting member 9 to be firmly tightened into the screw hole 19 when screwed thereinto, compared with the cylindrical body 20 formed of an insulating resin.

Second Connector Portion 3

Figure 6:
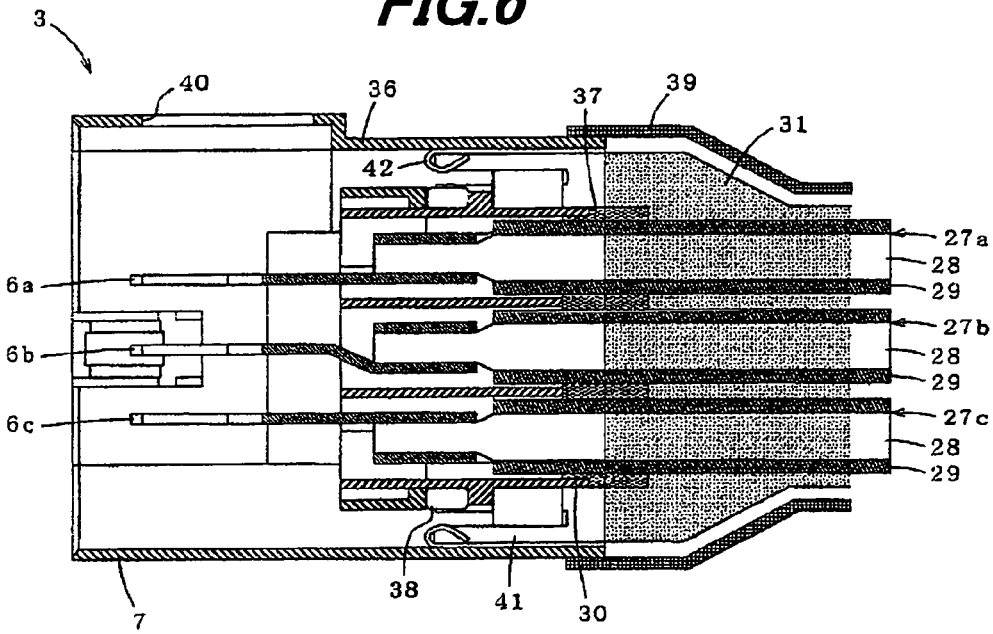
FIG. 6 is a cross-sectional view showing a second connector portion.

Referring to FIG. 6, the second connector portion 3 has the second terminal housing 7 with a plurality of (three) second connecting terminals (female terminals) 6*a* to 6*c* aligned and accommodated therein. Herein, the second connector portion 3 refers to the connector portion having the female terminals. That is, the second terminal housing 7 may be a male or female terminal housing. Herein is described the case that the second terminal housing 7 is a female terminal housing, in correspondence with the first terminal housing 5 being a male terminal housing.

The second connecting terminals 6*a* to 6*c* are connected with cables 27*a* to 27*c*, respectively, at one end, which extend from an inverter. These cables 27*a* to 27*c* are electrically connected to the first connecting terminals 4*a* to 4*c* via the second connecting terminals 6*a* to 6*c*, respectively, and therefore supplied with electricity at voltages and/or currents in correspondence to the second connecting terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held to be aligned at a specified pitch by a multi-cylindrical cable holding member 30. With this cable holding member 30, when the first connector portion 2 and the second connector portion 3 are fitted to each other, the second connecting terminals 6*a* to 6*c* are held to be positioned below the first connecting terminals 4*a* to 4*c* to face (i.e. to be connected to) the second connecting terminals 6*a* to 6*c* to form pairs respectively.

The cable holding member 30 is formed of an insulating resin, to isolate the second connecting terminals 6*a* to 6*c* from each other to prevent a short circuit. This cable holding member 30 allows the second connecting terminals 6*a* to 6*c* to be held at specified positions respectively, even when the cables 27*a* to 27*c* respectively connected to the second connecting terminals 6*a* to 6*c* have excellent flexibility. That is, in this embodiment, the cables 27*a* to 27*c* to be used can have excellent flexibility, and therefore enhance a degree of freedom of wiring the cables 27*a* to 27*c*.

Although the second connecting terminals 6*a* to 6*c* are positioned by the cable holding member 30 holding the cables 27*a* to 27*c*, more specifically, the ends near the second connecting terminals 6*a* to 6*c* of the cables 27*a* to 27*c* to hold the second connecting terminals 6*a* to 6*c* at specified positions respectively, the second connecting terminals 6*a* to 6*c* may be positioned by the cable holding member 30 holding the cables 27*a* to 27*c*, and the second connecting terminals 6*a* to 6*c* directly. Also, a connecting terminal holding member may, in place of the cable holding member 30, be used that holds not the cables 27*a* to 27*c*, but the second connecting terminals 6*a* to 6*c* directly.

In the case that, with the cable holding member 30, the second connecting terminals 6*a* to 6*c* are positioned by holding the cables 27*a* to 27*c* without directly holding the second connecting terminals 6*a* to 6*c*, that is, in the case of this embodiment, making the cables 27*a* to 27*c* flexible allows the tips of the second connecting terminals 6*a* to 6*c* to have flexibility relative to the second terminal housing 7. This construction permits flexible adaptation, even to deformation of first connecting terminal 4*a* to 4*c* portions to insert the second connecting terminals 6*a* to 6*c* in the first connector portion 2, when pressed by the connecting member 9.

Also, a braided shield 31 is wrapped around cables 27*a* to 27*c* portions drawn out of the second terminal housing 7, for the purpose of enhancement in shielding performance. This braided shield 31 is contacted with a later-described cylindrical shield body 41, and electrically connected through the cylindrical shield body 41 to the first terminal housing 5 (an equipotential (GND)). For simplification, no braided shield 31 is shown in FIGS. 1 and 2.

Second Connecting Terminals 6*a* to 6*c*

Figure 7A:
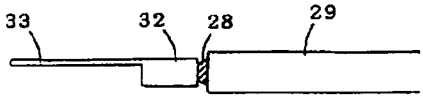
FIGS. 7A and 7B are a side view and a bottom view, respectively, showing a second connecting terminal.
Figure 7B:
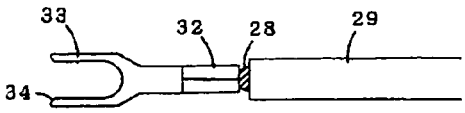
Figure 8A:
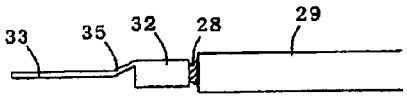
FIGS. 8A and 8B are a side view and a bottom view, respectively, showing a second connecting terminal.
Figure 8B:
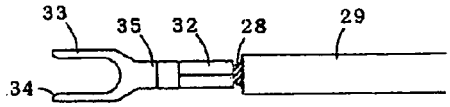

Referring to FIGS. 6 and 7, the second connecting terminals 6*a* to 6*c* respectively include calking portions 32 for calking the conductors 28 exposed from the tips of the cables 27*a* to 27*c*, and U-shaped contacts 33 formed integrally with the calking portions 32. At tips of the U-shaped contacts 33 are respectively formed tapered portions 34 to enhance the insertability of the U-shaped contacts 33. When the first connector portion 2 and the second connector portion 3 are fitted to each other, the U-shaped contacts 33 are inserted in such a manner as to grip the shaft 9*a* of the connecting member 9.

In this embodiment, to reduce the size of the connector 1, the cables 27*a* to 27*c* are configured to be aligned and held as close to each other as possible. To this end, as shown in FIG. 7, a trunk 35 of the second connecting terminal 6*b* to be connected to the cable 27*b* arranged in the middle when aligned is bent, to thereby space the second connecting terminals 6*a* to 6*c* apart at the same pitch.

The second connecting terminals 6*a* to 6*c* may each be constructed of a high electrical conductivity metal such as silver, copper, aluminum, or the like, in order to reduce the loss of power transmitted through the connector 1. Also, the second connecting terminals 6*a* to 6*c* each have slight flexibility.

Second Terminal Housing 7

Referring again to FIG. 6, the second terminal housing 7 is formed of a cylindrical hollow body 36 which is substantially rectangular in transverse cross section. To fit the first terminal housing 5 into the second terminal housing 7, an inner portion at one end (i.e., leftward in FIG. 6) of the cylindrical body 36 fitted to the first terminal housing 5 is formed in a tapered shape, taking into consideration the mateability with the first terminal housing 5.

Conversely, the second terminal housing 7 may be configured to be fitted into the first terminal housing 5. In this case, an inner portion at one end of the cylindrical body 20 constituting the first terminal housing 5 is formed in a tapered shape, while an outer portion at one end of the cylindrical body 36 constituting the second terminal housing 7 is formed in a tapered shape, so that the terminal housing waterproofing structure 21 may be formed in the outer portion at one end of the cylindrical body 36.

In the other end (i.e., rightward in FIG. 6) of the cylindrical body 36 is accommodated the cable holding member 30 with the cables 27*a* to 27*c* aligned and held therewith. On a cable insertion side of the cable holding member 30 is formed a packingless sealing portion 37, to prevent water from penetrating onto the cables 27*a* to 27*c* and into the female terminal housing 7. In an outer portion of the cable holding member 30 is provided a packing 38 to be in contact with an inner surface of the male terminal housing 5. That is, the connector 1 has a double waterproofing structure of the packing 23 of the terminal housing waterproofing structure 21 and the packing 38 provided in the outer portion of the cable holding member 30.

Further, the other end of the cylindrical body 36 from which the cables 27*a* to 27*c* are drawn out is covered with a rubber boot 39 for preventing water from penetrating into the cylindrical body 36. For simplification, no rubber boot 39 is shown in FIGS. 1 and 2.

Also, in an upper portion (i.e., upward in FIG. 6) of the cylindrical body 36 is formed a connecting member manipulation hole 40 for manipulating the connecting member 9 provided in the first connector portion 2 when the first connector portion 2 and the second connector portion 3 are fitted to each other. This connecting member manipulation hole 40 also serves as a through hole to permit the connecting member 9 to be inserted into or removed out of the first terminal housing 5, after the first terminal housing 5 and the second terminal housing 7 are fitted to each other. Since the connecting member manipulation hole 40 serves as the through hole, the connecting member 9 is possible to remove out of the connecting member manipulation hole 40 even with the first connector portion 2 and the second connector portion 3 fitted to each other. Therefore, for example, even when the packing 14 provided around the head 9*b* of the connecting member 9 unavoidably needs replacement due to corrosion occurring with time, it can be repaired or replaced by removing the connecting member 9 even without detaching the second connector portion 3 from the first connector portion 2. This therefore advantageously makes maintenance convenient.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of an insulating resin. Therefore, to enhance its shielding performance and heat dissipation, the cylindrical shield body 41 made of an aluminum (a copper alloy, iron, or stainless steel) is provided on an inner surface at the other end of the cylindrical body 36.

The cylindrical shield body 41 has a contact 42 to be contacted with an outer portion of the first terminal housing 5 made of an aluminum when the first connector portion 2 and the second connector portion 3 are fitted to each other. The cylindrical shield body 41 is thermally and electrically connected with the first terminal housing 5 via this contact 42. This enhances the shielding performance and the heat dissipation. In particular, the heat dissipation is likely to be significantly enhanced by positively allowing heat to escape toward the first terminal housing 5 having an excellent heat dissipation property.

Connection Between the First Connecting Terminals 4*a* to 4*c* and the Second Connecting Terminals 6*a* to 6*c*

Next is described the connection between the first connecting terminals 4*a* to 4*c* and the second connecting terminals 6*a* to 6*c* using the connector 1 in this embodiment.

Figure 9:
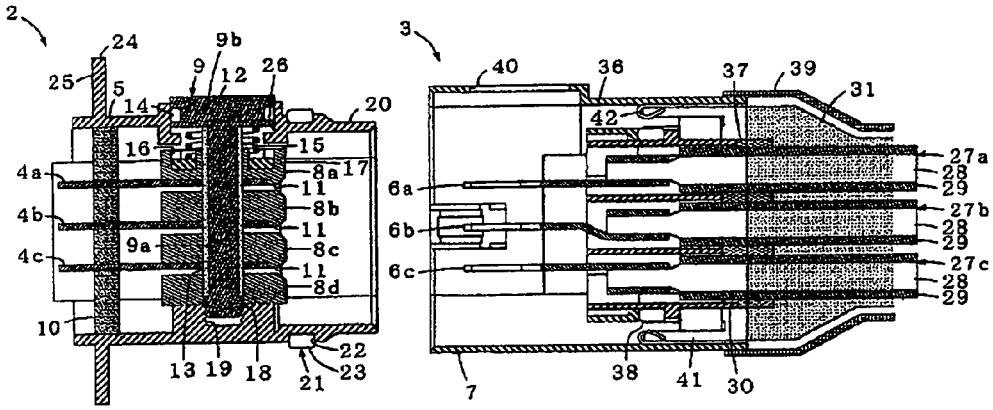
FIG. 9 is a cross-sectional view showing the connector before connecting together the first connector portion and the second connector portion.

Referring to FIG. 9, when the first connector portion 2 and the second connector portion 3 are fitted to each other as shown in FIG. 3 from an unconnected state as shown in FIG. 9, the second connecting terminals 6*a* to 6*c* are inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form pairs respectively. With that insertion, the plural first connecting terminals 4*a* to 4*c* and the plural second connecting terminals 6*a* to 6*c* then face each other to form pairs, respectively, and result in a stacked structure in which the pairs of the first connecting terminals 4*a* to 4*c* and the second connecting terminals 6*a* to 6*c* and the isolating plates 8*a* to 8*d* are disposed alternately, i.e. the pairs of the first connecting terminals 4*a* to 4*c* and the second connecting terminals 6*a* to 6*c* are alternately interleaved with the isolating plates 8*a* to 8*d*.

In this case, inside the first connector portion 2, the isolating plates 8*a* to 8*c* are respectively fixed to the tips of the first connecting terminals 4*a* to 4*c* held to be aligned at a specified pitch. A pitch between the isolating plates 8*a*, 8*b* and 8*c* can therefore be held, even without separately providing a holding jig (see JP patent No. 4037199) for holding the pitch between the isolating plates 8*a*, 8*b* and 8*c*. This allows the second connecting terminals 6*a* to 6*c* to be easily inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form the pairs respectively. That is, the insertability/removability of the second connecting terminals 6*a* to 6*c* is unlikely to deteriorate. Also, because of no need to provide a holding jig for holding the pitch between the isolating plates 8*a*, 8*b* and 8*c*, a further size reduction can very effectively be achieved, compared to the prior art.

Also, the contact between the first connecting terminal 4*a* (or 4*b*) and the second connecting terminal 6*a* (or 6*b*) is sandwiched between the first isolating plate 8*a* (or 8*b*) fixed to the first connecting terminal 4*a* (or 4*b*) constituting the contact, and the first isolating plate 8*b* (or 8*c*) fixed to the first connecting terminal 4*b* (or 4*c*) constituting the other contact. Likewise, the contact between the first connecting terminal 4*c* and the second connecting terminal 6*c* is sandwiched between the first isolating plate 8*c* fixed to the first connecting terminal 4*c* constituting the contact, and the second isolating plate 8*d* fixed to the inner surface of the first terminal housing 5.

Referring to FIG. 3, following that, the connecting member 9 is manipulated from the connecting member manipulation hole 40, to screw and tighten the screwing portion 18 of the connecting member 9 into the screw hole 19 of the first terminal housing 5. The connecting member 9 is then rotated and pressed into the bottom of the screw hole 19, and causes the elastic member 15 to, in turn, press the first isolating plate 8*a*, the first isolating plate 8*b*, the first isolating plate 8*c*, and the second isolating plate 8*d*, and sandwich the contacts between the isolating plates 8*a* and 8*b*, between the isolating plates 8*b* and 8*c*, and between the isolating plates 8*c* and 8*d*, respectively, with the contacts isolated from each other. In this case, by being pressed by the isolating plates 8*c* and 8*d*, the first connecting terminals 4*a* to 4*c* and the second connecting terminals 6*a* to 6*c* are slightly bent and contacted with each other, respectively, in a wide range. This allows each contact to be firmly contacted and fixed, even in a vibrational environment such as on vehicle.

Effects and Functions of the Embodiment

As described above, in this embodiment, in the upper surface in contact with the elastic member 15 of the first isolating plate 8*a* adjacent to the head 9*b* of the connecting member 9 is formed the recessed portion 16 which covers (accommodates) a lower portion of the substantially cylindrical metallic elastic member 15 disposed between the head 9*b* and the first isolating plate 8*a* adjacent to that head 9*b*. At the bottom of the recessed portion 16 is provided the receiving member 17 made of a metal (e.g. SUS, or the like) which receives the elastic member 15 and which is for preventing damage to the first isolating plate 8*a* formed of a non-conductive resin.

For that reason, the height of the elastic member 15 exposed from the upper surface of the first isolating plate 8*a* can be lowered by the amount accommodated in the recessed portion 16, and the slimming of the connector 1 can therefore be ensured, compared to the prior art. That is, the slimming of the connector 1 can be ensured, even when providing the elastic member 15 for exerting a pressing force.

As described previously, the recessed portion 16 in the connector 1 in the first embodiment is formed in such a shape as to cover a lower portion of the elastic member 15. As shown in FIG. 3, in the first embodiment, the connecting member 9 is configured to penetrate the first isolating plate 8*a*, and the recessed portion 16 is therefore formed in such a shape as to cover an inner surface of the lower portion of the substantially cylindrical elastic member 15 with a central axial hollow therein, as well as an outer surface of the lower portion of the elastic member 15. This configuration allows the suppression of the electricity movement from the contact to the elastic member 15 through the interface between the connecting member 9 and the first isolating plate 8*a*, as well as through the air at an end of the first isolating plate 8*a*.

Also, by the metallic receiving member 17 provided at the bottom of the recessed portion 16 receiving the pressing force of the elastic member 15, the elastic member 15 can be prevented from contacting the upper surface of the first isolating plate 8*a* at a small contact area and exerting an excessive force to the first isolating plate 8*a* formed of a resin, and the possibility of damaging the first isolating plate 8*a* can therefore be reduced. That is, the reliability and durability of the connector 1 can be enhanced.

Also, although in this embodiment, the first connecting terminals 4*a* to 4*c* and the second connecting terminals 6*a* to 6*c* are in surface contact with each other respectively, the first connecting terminal 4*a* to 4*c* contact surfaces to be contacted with the second connecting terminals 6*a* to 6*c* may be formed with protruding portions, and the U-shaped contacts 33 of the second connecting terminals 6*a* to 6*c* may be configured to be fitted onto these protruding portions, respectively. This configuration allows the further stabilization of the coupling force of the first connecting terminals 4*a* to 4*c* and the second connecting terminals 6*a* to 6*c*, respectively. That is, this configuration is especially effective for vibration perpendicular to the connecting member 9.

Also, although in this embodiment, the lengths of the branch tips of each U-shaped contact 33 of the second connecting terminals 6*a* to 6*c* are the same, one length thereof may be formed to be long to form a J-shaped contact. The J-shaped contact allows the second connector portion 3 to be inserted into the shaft 9*a* of the connecting member 9 obliquely relative to the cable longitudinal direction.

Also, although in this embodiment, the screw hole 19 is formed in the first terminal housing 5, only a through hole, not the screw hole 19 may be formed in the first terminal housing 5, and the screw hole 19 may be formed in the second terminal housing 7. Also, the screw hole 19 may be formed both in the first terminal housing 5 and the second terminal housing 7.

Although in this embodiment, the screw hole 19 is formed at such a position as to be screwed onto the screwing portion 18 at the tip of the connecting member 9, the screwing portion 18 may be formed in the head 9*b* of the connecting member 9, and the screw hole 19 may be formed to be screwed onto the screwing portion 18 formed in the head 9*b*.

Although the connector 1 in the first embodiment has been described, one of the features of the connector 1 in the first embodiment is that, unlike a later-described connector 100 in a second embodiment, the shaft 9*a* of the connecting member 9 penetrates each contact between the plural first connecting terminals 4*a* to 4*c* and the plural second connecting terminals 6*a* to 6*c* and the plural isolating plates 8*a* to 8*d*. This configuration allows the facilitation of the constant respective positional relationships of between the first connecting terminals 4*a* to 4*c* and the second connecting terminals 6*a* to 6*c* relative to the central connecting member 9.

Second Embodiment

Figure 10:
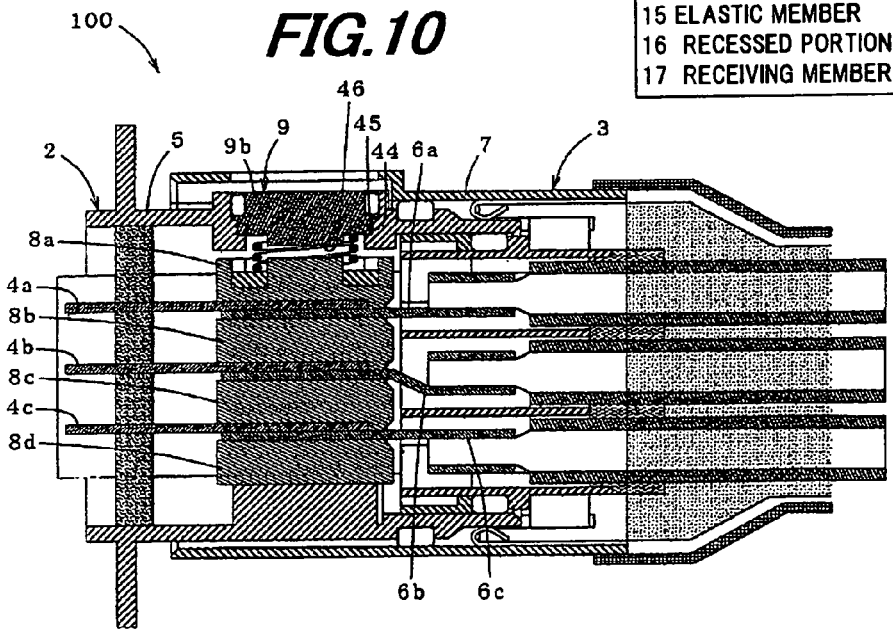
FIG. 10 is a cross-sectional view showing a connector after connecting together the first connector portion and the second connector portion, in a second embodiment according to the invention.

Next is described a connector 100 in a second embodiment according to the invention, referring to FIG. 10.

Connector 100 Structure

As shown in FIG. 10, the connector 100 in this embodiment is different from the previously described connector 1 in the first embodiment in that the connecting member 9 does not penetrate each contact between the plural first connecting terminals 4*a* to 4*c* and the plural second connecting terminals 6*a* to 6*c* and the plural isolating plates 8*a* to 8*d*. That is, in this embodiment, the connecting member 9 is constructed of only the head 9*b* serving as the pressing portion.

In the connector 1 in the first embodiment, the screwing portion 18 formed in the shaft 9*a* is screwed into the screw hole 19 of the first terminal housing 5 to thereby tighten the connecting member 9 into the first terminal housing 5, whereas in the connector 100 in this embodiment, the connecting member 9 is formed of only the head 9*b*, and the connector 100 is therefore configured so that a male screwing portion 44 is formed in such a manner as to push the packing 14 around the head 9*b*, while a female screw 45 into which the screwing portion 44 is screwed is cut in an inner portion of the connecting member insertion hole 26 of the first terminal housing 5, to screw the screwing portion 44 into the female screw 45 and thereby tighten the connecting member 9 into the first terminal housing 5.

As shown in FIG. 10, the head 9*b* is shaped to have a large diameter portion provided with the packing 14 and a small diameter portion formed with the male screwing portion 44, and to shape the connecting member insertion hole 26 to have those two diameter dimensions. With this configuration, when the head 9*b* is tightened into the connecting member insertion hole 26, the male screwing portion 44 is not disposed in a portion facing the packing 14. This can therefore ensure its effective waterproofing structure.

Also, on a lower surface (i.e., on the lower surface facing the first isolating plate 8*a*) of the head 9*b* of the connecting member 9 is formed an elastic member holding portion 46 for engaging and holding the elastic member 15. The elastic member 15 is held by this elastic member holding portion 46 to form a portion of the connecting member 9.

The connection of the first connecting terminals 4*a* to 4*c* and the second connecting terminals 6*a* to 6*c* using this connector 100 is performed in the same procedure as that of the previously described connector 1 in the first embodiment. That is, the connection of the first connector portion 2 and the second connector portion 3 is followed by tightening the male screwing portion 44 of the connecting member 9 into the female screw 45 of the first terminal housing 5, concurrently with this, sequentially exerting the pressing force of the elastic member 15 to the isolating plates 8*a* to 8*d*, and pressing the contacts to be sandwiched between the isolating plates 8*a* and 8*b*, 8*b* and 8*c*, and 8*c* and 8*d*, respectively, to thereby connect the first connecting terminals 4*a* to 4*c* and the second connecting terminals 6*a* to 6*c*, respectively. This allows the first connecting terminals 4*a* to 4*c* and the second connecting terminals 6*a* to 6*c* to be firmly fixed to each other respectively.

In the second embodiment, the recessed portion 16 is also then formed in such a shape as to cover a lower portion of the elastic member 15 in the same manner as in the first embodiment. This configuration allows the suppression of the electricity movement from the contact to the elastic member 15 through an end of the first isolating plate 8*a*.

In the case of the second embodiment, since the connecting member 9 is configured so as not to penetrate the first isolating plate 8*a*, the recessed portion 16 may be not necessarily formed in such a shape as to cover an inner surface of the lower portion of the substantially cylindrical elastic member 15 with a central axial hollow therein.

Also, in this embodiment, since the connecting member 9 does not penetrate each contact between the plural first connecting terminals 4*a* to 4*c* and the plural second connecting terminals 6*a* to 6*c* and the plural isolating plates 8*a* to 8*d*, there is no need to form the contacts of the second connecting terminals 6*a* to 6*c* in such a shape as to avoid the connecting member 9 (e.g. in the previously mentioned U-shape).

Although the connector 100 in the second embodiment has been described, one of the features of the connector 100 in the second embodiment is that, unlike the previously described connector 100 in the first embodiment, the connecting member 9 does not penetrate each contact between the plural first connecting terminals 4*a* to 4*c* and the plural second connecting terminals 6*a* to 6*c* and the plural isolating plates 8*a* to 8*d*. This configuration results from fixing the plural isolating plates 8*a* to 8*c* to the other surfaces of the plural first connecting terminals 4*a* to 4*c* respectively, and can ensure the cost reduction of the connecting member 9. Also, this leads to the weight reduction of the connecting member 9, thus allowing a contribution to the weight reduction of the entire connector.

The invention is not limited to the above-described embodiments, but various alterations are possible in the scope not departing from the gist of the invention.

Also, although in this embodiment, three phase alternating power lines have been assumed, according to the technical idea of the invention, the connector for a vehicle, for example, may be configured to collectively connect lines for different uses, such as three phase alternating current power lines for between a motor and an inverter, two phase direct current power lines for an air conditioner, and the like. This configuration allows power lines for a plurality of uses to be collectively connected by one connector. There is therefore no need to prepare a different connector for each use, to thereby allow a contribution to space saving or low cost.

Also, although in this embodiment, when viewed from the head 9*b* of the connecting member 9, the first connecting terminals 4*a* to 4*c* and the second connecting terminals 6*a* to 6*c* have been configured to be linearly contacted with each other respectively, the first terminal housing 5 and the second terminal housing 7 may be configured so that, when viewed from the head 9*b* of the connecting member 9, the first connecting terminals 4*a* to 4*c* of the first connector portion 2 cross and contact the second connecting terminals 6*a* to 6*c* of the second connector portion 3 respectively at a right angle thereto. That is, the first connector portion 2 and the second connector portion 3 may be fitted to each other in an L-shape. Likewise, the second terminal housing 7 and the second connecting terminals 6*a* to 6*c* may be configured to be disposed obliquely relative to the first terminal housing 5 and the first connecting terminals 4*a* to 4*c* respectively. By thus applying the gist of the invention, the direction of inserting/removing the second connector portion 3 relative to the first connector portion 2 may be varied. That is, the direction of drawing the cables out from the connector can be fitted to the shape of an installation portion, to thereby allow a contribution to space saving.

Also, although in this embodiment it has been described that, unlike the second connecting terminals 6*a* to 6*c*, the first connecting terminals 4*a* to 4*c* are not connected with cables respectively at one end, the first connecting terminals 4*a* to 4*c* are not limited to this structure. In other words, the connector in this embodiment may also be utilized when interconnecting cables with each other.

Also, although in this embodiment, the cables 27*a* to 27*c* used have excellent flexibility, rigid cables may be used.

Also, although in this embodiment, the bolt 12 has been described as the example of the connecting member 9, the connecting member 9 construction is not intended to be limited to bolt shape, but the connecting member 9 may, for example, be configured to be interconnected with a shaft of a CPA (connector position assurance) lever for fixing the connection of the first connector portion 2 and the second connector portion 3, to turn the CPA lever to fix the connection thereof, and press (or tighten) the connecting member 9 from the head 9*b* toward the tip of the shaft 9*a* of the connecting member 9.

Also, although in this embodiment, the upper surface of the head 9*b* of the bolt 12 used as the connecting member 9 has been assumed as being formed with a recessed portion, into which is engaged a commercial hexagonal wrench (also called hexagonal spanner), the upper surface of the head 9*b* of the bolt 12 used as the connecting member 9 may be configured to be formed with a recessed portion shaped to fit onto an uncommercial exclusive tool shape assumed to be used.

Also, in this embodiment, the use orientation of the connector is such that the connecting member 9 may be substantially horizontal or substantially vertical. In other words, the use conditions of the connector in this embodiment require no use orientation.

Also, although in this embodiment, the head 9*b* of the connecting member 9 is pressed against the adjacent isolating plate 8*a* via the elastic member 15 constituting a portion of the connecting member 9, the head 9*b* may be pressed directly against the adjacent isolating plate 8*a*, not via the elastic member 15.

Also, the terminal surfaces of the first connecting terminals 4*a* to 4*c* and the second connecting terminals 6*a* to 6*c* may be knurled to make their frictional force large, so that the terminals are thereby unlikely to move relative to each other, and are firmly fixed at the contacts therebetween respectively.

Also, in this embodiment, the range of the lower portion of the elastic member 15 to be covered by the recessed portion 16, i.e. the depth of the recessed portion 16 is designed by taking into consideration such a creeping distance as to be able to isolate the elastic member 15 from the contact.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A connection structure, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a head and a shaft connected to the head, the shaft being adapted to penetrate contacts between the plurality of first connecting terminals and the plurality of second connecting terminals and the plurality of isolating plates, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, the connecting member further comprising at least a portion comprising an insulating material for penetrating the contacts, wherein the connecting member further comprises a metallic elastic member disposed between the head and the isolating plate adjacent to the head to sequentially press the plurality of isolating plates in a stacking direction, and the isolating plate adjacent to the head comprises a recessed portion formed in a surface to contact the elastic member for accommodating one end of the elastic member pressing the isolating plate adjacent to the head.

2. The connection structure according to claim 1, further comprising:

a metallic receiving member at a bottom of the recessed portion for receiving the elastic member.

3. The connection structure according to claim 1, wherein the first terminal housing comprises a connecting member insertion hole for inserting the connecting member thereinto, and the connecting member further comprises a waterproofing structure on an outer surface of the head for sealing between the outer surface of the head and an inner surface of the connecting member insertion hole of the first terminal housing.

4. The connection structure according to claim 3, wherein the connecting member insertion hole is formed cylindrical, and bent inward at an end of the cylindrical shape facing into the first terminal housing, and a rim of a lower surface of the head of the connecting member is contacted with the bent end of the connecting member insertion hole, to thereby regulate the stroke of the connecting member.

5. The connection structure according to claim 1, wherein the first terminal housing comprises a male terminal housing, the second terminal housing comprises a female terminal housing, and the second terminal housing comprises a through hole for permitting the connecting member to be inserted into or removed out of the first terminal housing after the first terminal housing and the second terminal housing are fitted to each other.

6. The connection structure according to claim 1, wherein the plurality of second connecting terminals are connected with flexible cables, respectively, at one end, and the second terminal housing further comprises a cable holding member for holding the cables, so that the plurality of second connecting terminals are held at specified positions, respectively, with flexibility relative to the second terminal housing.

7. A connection structure, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a head adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, wherein the connecting member further comprises a metallic elastic member disposed between the head and the isolating plate adjacent to the head to sequentially press the plurality of isolating plates in a stacking direction, and the isolating plate adjacent to the head comprises a recessed portion formed in a surface to contact the elastic member for accommodating one end of the elastic member pressing the isolating plate adjacent to the head.

8. The connection structure according to claim 7, further comprising:

a metallic receiving member at a bottom of the recessed portion for receiving the elastic member.

* * * * *